US008814544B2

(12) United States Patent
Ebinger et al.

(10) Patent No.: US 8,814,544 B2
(45) Date of Patent: Aug. 26, 2014

(54) ROTARY PUMP WITH IMPROVED SEAL

(71) Applicant: Schwäbische Hüttenwerke Automotive GmbH, Aalen-Wasseralfingen (DE)

(72) Inventors: Jürgen Ebinger, Ochsenhausen (DE); Michael Ehringer, Bad Schussenried (DE); Kim Boris Friedrich, Ilshofen-Gaugshausen (DE); Stefan Küchle, Biberach (DE); Boris Memel, Bad Schussenried (DE); Sven Peters, Bad Schussenried (DE); Lothar Preisler, Bad Schussenried (DE); Anton Schmid, Ummendorf (DE); Klaus Wiggenhauser, Ostrach (DE)

(73) Assignee: Schwabische Huttenwerke Automotive GmbH, Aalen-Wasseralfingen (DE)

( * ) Notice: Subject to any disclaimer, the term of this patent is extended or adjusted under 35 U.S.C. 154(b) by 133 days.

(21) Appl. No.: 13/671,674

(22) Filed: Nov. 8, 2012

(65) Prior Publication Data

US 2013/0121867 A1 May 16, 2013

(51) Int. Cl.

| | |
|---|---|
| ***F04C 2/00*** | (2006.01) |
| ***F04C 14/18*** | (2006.01) |
| ***F04C 29/00*** | (2006.01) |
| ***F04C 15/00*** | (2006.01) |
| ***F04C 14/22*** | (2006.01) |
| *F04C 2/344* | (2006.01) |

(52) U.S. Cl.

CPC ..... *F04C 29/00* (2013.01); *F04C 15/0034* (2013.01); *F04C 14/226* (2013.01); *F04C 2/344* (2013.01)

USPC ..... 418/26; 418/27; 418/30; 417/220

(58) Field of Classification Search

CPC .... F04C 14/226; F04C 15/0034; F04C 29/00; F04C 2/344

USPC ..... 418/26–30, 259, 266–268; 417/213, 417/218–220, 310

See application file for complete search history.

(56) References Cited

U.S. PATENT DOCUMENTS 3,924,970 A * 12/1975 Johnston et al. ..... 417/220
4,557,670 A * 12/1985 Inagaki et al. ..... 417/299

(Continued)

FOREIGN PATENT DOCUMENTS

DE 10 2006 061 326 A1 7/2008
WO WO 2006/066405 A1 6/2006

(Continued)

OTHER PUBLICATIONS

English Translation of German Office Action for German Application No. 10 2011 086 175.0 mailed Jun. 22, 2012.

(Continued)

*Primary Examiner* — Hoang Nguyen
(74) *Attorney, Agent, or Firm* — RatnerPrestia

(57) ABSTRACT

A rotary pump with an improved seal on a control pressure chamber, including: a housing having a delivery chamber; a feed wheel rotatable in the delivery chamber; an actuating member surrounding the feed wheel forming delivery cells and moveable in the housing relative to the feed wheel. The control pressure chamber is delineated by the actuating member together with axially facing axial co-operating surfaces, forming an axial sealing gap and a radial sealing gap. A control fluid can be introduced into the control pressure chamber for applying pressure to the actuating member to exert an actuating force in the actuating direction; a restoring device for generating a restoring force; and a sealing element arranged on the actuating member or the circumferential co-operating surface. To compensate for a change in gap width of one of the axial sealing gaps, a base leakage cross-section is provided on the sealing element.

18 Claims, 3 Drawing Sheets

(56) References Cited

U.S. PATENT DOCUMENTS

| | | | | |
|---|---|---|---|---|
| 5,562,432 | A * | 10/1996 | Semba et al. | 418/26 |
| 6,722,856 | B2 * | 4/2004 | Schneider | 417/220 |
| 6,763,797 | B1 * | 7/2004 | Staley et al. | 123/196 R |
| 7,794,217 | B2 | 9/2010 | Williamson et al. | |
| 8,057,201 | B2 | 11/2011 | Shulver et al. | |
| 8,186,969 | B2 * | 5/2012 | Morita et al. | 417/220 |
| 2011/0189043 | A1 | 8/2011 | Watanabe et al. | |
| 2012/0148423 | A1 | 6/2012 | Wagner | |

FOREIGN PATENT DOCUMENTS

| | | | |
|---|---|---|---|
| WO | WO 2007/128105 | A1 | 11/2007 |
| WO | WO 2010/142611 | A1 | 12/2010 |

OTHER PUBLICATIONS

German Office Action for German Application No. 10 2011 086 175.0 mailed Jun. 22, 2012.

* cited by examiner

ROTARY PUMP WITH IMPROVED SEAL

CROSS-REFERENCE TO RELATED APPLICATIONS

This application claims priority to German Patent Application No. 10 2011 086 175.0, filed Nov. 11, 2011, the contents of such application being incorporated by reference herein.

FIELD OF THE INVENTION

The invention relates to a rotary pump, in particular a rotary displacement pump, with an improved seal in the region of a movable actuating member of the pump. The rotary displacement pump can in particular be a vane cell pump or reciprocating piston valve pump; however, other pumps can also in principle be realized using the invention.

BACKGROUND OF THE INVENTION

Rotary pumps comprise a rotatable feed wheel and, for adjusting their specific delivery volume, an actuating member which surrounds the feed wheel and can be moved back and forth and to which a control fluid is applied in one direction of its mobility and a restoring force is applied counter to the control fluid force exerted by the control fluid. The pressure of the control fluid is dependent on the pressure of the fluid delivered by the pump. In most applications, a portion of the fluid delivered by the pump is diverted and fed to the actuating member as the control fluid. In order to seal a control pressure space to which the control fluid is applied, the actuating member forms a radial sealing gap at its circumference in sliding contact with a co-operating surface, and a sealing gap at each of its axial facing sides. Due to differences in the thermal expansion of the components forming the sealing gaps, the widths of the sealing gaps change as a function of the temperature of the pump. In most pump embodiments, the sealing gaps increase in size as the temperature increases. The sealing gaps can also increase in size due to wear, in particular during running-in. Production tolerances are another cause of inaccuracies with regard to the delivery volume. If the pump is regulated down by means of the control fluid, i.e. the control fluid is applied to the actuating member in the direction of reducing the specific delivery volume, then the pressure level at which the pump begins to be regulated down shifts with temperature and, over time, wear. Production tolerances are responsible for differences from pump to pump.

Pumps such as the invention relates to inter alia are known for example from WO 2006/066405 A1, WO 2007/128105 A1 and WO 2010/142611 A1, which are incorporated by reference. Sealing elements which are arranged in the circumferential sealing gaps are used to improve the seal.

SUMMARY OF THE INVENTION

It is an aim of the invention to more reliably ensure the setting of a requirement-adjusted delivery volume and/or pressure of an adjustable rotary pump, in particular a rotary displacement pump.

The invention proceeds from a rotary pump, for example a rotary displacement pump, which comprises: a housing with a delivery chamber; a feed wheel which can be rotated about a rotational axis in the delivery chamber; and an actuating member which surrounds the feed wheel. The housing comprises an inlet on a low-pressure side, and an outlet on a high-pressure side, for a fluid. The inlet and the outlet are connected to the delivery chamber. The feed wheel and the actuating member together form delivery cells which, when the feed wheel is rotary-driven in a rotational direction of the feed wheel, increase in size on a low-pressure side of the delivery chamber which is in communication with the inlet and decrease in size on a high-pressure side of the delivery chamber which is in communication with the outlet, in order to deliver the fluid from the inlet to the outlet. The actuating member can be moved back and forth in the housing relative to the feed wheel, in an actuating direction and an actuating counter direction, in order to adjust the specific delivery volume of the displacement pump. The actuating member delineates a control pressure chamber. It is in sliding contact at its outer circumference with a facing circumferential co-operating surface, with which it forms—in said sliding contact—a sealing gap which is radial in relation to the rotational axis of the feed wheel. It also forms axial sealing gaps with axially facing axial co-operating surfaces, in order to delineate and consequently seal the control pressure chamber. The circumferential co-operating surface and the axial co-operating surfaces can be formed by the housing, preferably directly by the housing. In this context, a housing cover is regarded as a part of the housing. Thus, one of the axial co-operating surfaces can in particular be formed by a housing part which accommodates the feed wheel and the actuating member, and another, axially opposite axial co-operating surface can be formed by a housing cover. If one or more of the co-operating surfaces is/are formed by one or more inserts which is/are immovably inserted in the housing, then such inserts are also regarded as forming part of the housing. The pump also comprises a restoring device for generating a restoring force which acts on the actuating member in the actuating counter direction and is preferably a spring force. The restoring device can comprise a mechanical spring, for example a helical pressure spring, in order to generate the restoring force, which also includes preferred embodiments in which the restoring device consists of a mechanical spring.

In order to form the radial sealing gap, a sealing element is arranged on the actuating member or on the circumferential co-operating surface. If the sealing element is arranged on the circumferential co-operating surface, it is situated in sliding contact with the actuating member. The sealing element is more preferably arranged on the actuating member and in sliding contact with the circumferential co-operating surface. The sealing element is preferably inserted into a receptacle on the outer circumference of the actuating member or on the circumferential co-operating surface. In preferred embodiments, the pump comprises a pressing device for generating a pressing force which acts on the sealing element and presses it into the sliding contact. In this way, changes in the gap width of the radial sealing gap—as measured in a direction which is orthogonal to the rotational axis of the delivery member—between the actuating member and the circumferential co-operating surface can be compensated for.

While the pump is in operation, however, fluid leaks from the high-pressure side of the delivery chamber into the control pressure chamber via the axial sealing gaps. This leakage increases the pressure in the control pressure chamber and causes the down-regulation onset to shift to a lower pressure level. As mentioned at the beginning, the leakage via the axial sealing gaps is likewise dependent on production tolerances, wear and in particular the temperature of the pump, wherein increasing wear always causes said leakage to increase and the down-regulation onset to correspondingly shift towards lower pump pressures, and increases in temperature cause said leakage to increase and the down-regulation onset to correspondingly shift towards lower pump pressures in most embodiments. In order to compensate for changes in the gap width of the axial sealing gaps as measured in the axial direction, or as applicable the gap width of the radial sealing gap, a base leakage cross-section is provided on the sealing element, through which control fluid can specifically flow off, i.e. in a way which is predetermined by the flow cross-section of the base leakage cross-section, from the control pressure chamber to the low-pressure side of the pump. In preferred embodiments, one or more base leakage cross-sections is/are provided exclusively on the sealing element. In principle, however, it is also possible for one or more base leakage cross-sections to be provided on the sealing element and for one or more other base leakage cross-sections to be additionally provided on one of the co-operating surfaces of the sealing element. The co-operating surfaces of the sealing element are the circumferential co-operating surface with which the sealing element forms the radial sealing gap in sliding contact, and the axial co-operating surfaces in the region of the axial ends of the sealing element. The base leakage cross-section(s) in accordance with the invention sets/set, in a predetermined way, a base leakage which is independent of changes in the axial gap width and therefore independent of the extent of wear and temperature of the pump and which is moreover only subject to its own production tolerance, i.e. the production tolerance of the base leakage cross-section. The at least one base leakage cross-section can however be simply and therefore cheaply formed to a production tolerance which is low in comparison with the dimensions of the gap. The pressure delivered by the pump to a consumer, for example a combustion engine, can consequently be more accurately set or maintained than in conventional pumps.

The sealing element can for example as a whole be axially short of the actuating member, such that the base leakage cross-section at one of the axial ends of the sealing element or a base leakage cross-section at each of the two axial ends of the sealing element remains free over the entire cross-section of the sealing element in the axial extension of the sealing element. The one or more base leakage cross-section(s) can in particular be formed on the sealing element. In such embodiments, the actuating member and the sealing element can exhibit the same axial length, or one or both axial ends of the sealing element can even protrude slightly beyond the respective facing surface of the actuating member in the direction of the respective axial co-operating surface. Forming the base leakage cross-section on the sealing element includes embodiments in which the base leakage cross-section extends on a sealing surface, situated in sliding contact, in an axially middle region of the sealing element. Arranging the base leakage cross-section in the region of one of the axial sealing gaps is preferred over arranging it merely in the region of the radial sealing gap. A cavity which forms the base leakage cross-section can in particular be provided, preferably formed, at an axial end of the sealing element. It is also possible for a cavity or recess to be formed on the sealing element and for a cavity or recess which corresponds to the cavity or recess on the sealing element and forms common flow cross-section to be formed on the opposite co-operating surface, for example one of the axial co-operating surfaces or the circumferential co-operating surface which forms the radial sealing gap. Expediently, however, the base leakage cross-section(s) is/are formed on the sealing element only.

In developments, a cavity which forms the base leakage cross-section is formed on a front side of the sealing element which faces the circumferential co-operating surface or on a rear side of the sealing element which faces the actuating member. This applies to preferred embodiments in which the sealing element is arranged on the actuating member. In embodiments in which the sealing element is arranged on the circumferential co-operating surface, the cavity which forms the base leakage cross-section would be formed on a front side of the sealing element which faces the outer circumference of the actuating member or on a rear side of the sealing element which faces the housing wall in which the sealing element would be arranged in such embodiments. The cavity preferably extends as far as an axial end of the sealing element. It is also in particular possible for a first base leakage cross-section to be formed as a cavity on the front side of the sealing element and for another, second base leakage cross-section to be formed as a cavity on the rear side of the sealing element. If, as is preferred, the cavity extends to the axial end of the sealing element, then it can be formed such that the front side or rear side of the sealing element tapers, gradually or preferably via a step and/or shoulder, towards the axial end in question. The sealing element can also taper circumferentially, for example conically, at the axial end in question. It is however preferred if it tapers via a step and/or shoulder.

A base leakage cross-section is preferably provided at each of the two axial ends of the sealing element. The at least two base leakage cross-sections are advantageously formed on the sealing element. The base leakage cross-sections can be formed both on the front side or both on the rear side of the sealing element. The sealing element can also comprise a base leakage cross-section on both the front side and rear side at each of the two axial ends, i.e. can comprise at least four base leakage cross-sections in total.

It is advantageous for assembling the pump if the sealing element is mirror-symmetrical with regard to the base leakage cross-sections or in principle in terms of its shape, the base leakage cross-sections are for example provided mirror-symmetrically with respect to a middle axis of the sealing element which extends in an actuating direction, or the sealing element is formed at its front side as it is at its rear side, i.e. mirror-symmetrically with respect to an axial plane which extends between the front side and the rear side. The respective mirror-symmetry need not necessarily be perfect. Embodiments in which mirror-symmetry is broadly realized, such that when the sealing element is inserted into a receptacle formed on the circumferential co-operating surface or preferably the actuating member, the front side and rear side or the left-hand axial end and right-hand axial end can be interchanged, are also advantageous.

The base leakage cross-section exhibits a height, as measured radially, of preferably at least 0.01 mm, more preferably at least 0.05 mm. If, as is preferred, a plurality of base leakage cross-sections are provided, this applies respectively to each of the base leakage cross-sections. If only one base leakage cross-section is provided, then said base leakage cross-section exhibits a width, as measured in the axial direction of the pump, of preferably at least 5% of the length of the sealing element as measured in the same direction. The width is preferably at most 50% of the length of the sealing element, i.e. the base leakage cross-section advantageously extends over at most 50% of the length of the sealing element. The base leakage cross-section is preferably identical throughout, i.e. constant, as viewed in the flow direction of the control fluid which flows through it when the pump is in operation. If, however, the base leakage cross-section varies in terms of its size or shape, the preferred minimum and maximum limits of the width advantageously apply over the entire length of the base leakage cross-section. If a plurality of base leakage cross-sections are provided, then the above dimensioning rules for the width apply to the plurality of base leakage cross-sections in total, i.e. the plurality of base leakage cross-sections taken together exhibit a width of preferably at most 50% of the total length of the sealing element. In such embodiments, the preferred minimum value for the width likewise applies to the sum of the widths of the plurality of base leakage cross-sections.

In preferred embodiments, the sealing element is pressed into sliding contact by means of a pressing force. In such embodiments, the displacement pump comprises a pressing device for generating the pressing force. The pressing force can be a spring force which is generated by one or more mechanical or pneumatic spring member(s). The sealing element itself can also form the spring member of the pressing device, for example if the sealing element is formed as an elastic sealing ring, for example a spring-elastic O-ring. One or more spring members can however also be provided in addition to the sealing element and can act on the sealing element in order to press it into sliding contact.

The pressing force can in particular be hydraulically generated. A hydraulic pressing device can be supplemented with one or more spring members, i.e. the pressing force can be hydraulically and mechanically generated. More preferably, however, the pressing device is formed as a purely hydraulic pressing device and the pressing force is correspondingly a purely hydraulic pressing force. A hydraulic pressing device can be realized in a simple design and is robust and therefore durable, since an additional spring device—i.e. one or more spring members—still need not be additionally provided, and signs of material fatigue are also not to be expected. The hydraulic pressing force can advantageously be generated by means of the control fluid. In principle, however, the hydraulic pressing force can instead also be generated by means of another fluid, for example the fluid diverted at another location on the high-pressure side of the pump, or in principle even by a fluid which is supplied especially for generating the pressing force and which is not delivered by the pump. Generating the pressing force using fluid from the control pressure space can, however, be realized in a simple design and also does not risk retroactive effects on the pressure in the control pressure space which disrupt the regulating characteristics of the pump.

In advantageous embodiments, the pressing device comprises a connecting channel via which a fluid, preferably the control fluid, can be applied to the sealing element on its rear side which faces away from the sliding contact. The connecting channel preferably connects a pressure space, which is formed on the rear side of the sealing element, to the control pressure space. If the sealing element is arranged on the actuating member, the connecting channel extends in or on the actuating member. If the sealing element is arranged on the circumferential co-operating surface and/or a housing wall which forms the circumferential co-operating surface, the connecting channel extends through a wall of the housing or is formed as a recess on one of the axial co-operating surfaces or on the circumferential co-operating surface, in order to guide the fluid which generates the pressing force to the rear side of the sealing element.

In first embodiments, a recess is advantageously provided on the rear side of the sealing element for applying pressure to it. In order to apply the pressure as evenly as possible over the axial length of the sealing element, the recess correspondingly extends over a large portion—expediently, over a predominant portion—of the length and preferably over the entire length of the sealing element. Irrespective of whether the sealing element is arranged on the actuating member or on the circumferential co-operating surface, the recess can be formed on the rear side of the sealing element which faces away from the sliding contact. Alternatively, the recess can—or a corresponding recess can additionally—be formed on the actuating member or on the circumferential co-operating surface, facing the rear side of the sealing element. As already mentioned, the recess is connect to the control pressure space via the connecting channel in preferred embodiments. Providing the recess not on the sealing element but rather, in second embodiments, on either the actuating member or the circumferential co-operating surface depending on its arrangement, facilitates producing the sealing element in a geometry such that the sealing element does not have a predetermined front side and rear side, but rather the front side and rear side can be identical at least to the extent that it is not necessary to differentiate between the front side and the rear side of the sealing element in relation to installing it. This facilitates its assembly and reduces the risk of it being incorrectly installed.

The recess can be formed on the rear side of the sealing element, for example as a pocket or groove. The pocket or groove is preferably axially elongated. It is in accordance with preferred embodiments if the sealing element comprises a flat groove or flat channel over its entire length as viewed in cross-section. The sealing element can then for example be U-shaped in cross-section, such that a seal with respect to the circumferential co-operating surface is obtained in the region of the base of such a U-shaped sealing element profile, and a lateral seal for the accommodating space in which the sealing element is arranged is obtained by means of each of the two limbs of the U-shaped cross-section which project from the base, and leaks of the pressure fluid which generates the pressing force are thus reduced. For the distribution of the pressure fluid for generating the pressing force, no sealing surface is lost on the sides when the pressure fluid is distributed by means of a recess.

The sealing element can be produced from any material which is suited to the operational conditions of the pump, for example aluminum or steel or advantageously also a sufficiently heat-resistant plastic. Producing the sealing element from plastic, or as applicable also from a plastic coating only, has tribological advantages. It is possible to more reliably ensure that the sealing element can be moved in its receptacle with little friction, which is in any event advantageous for the preferred embodiments in which the sealing element is pressed into sliding contact in a receptacle which is preferably formed by the actuating member, and can therefore be moved transverse to the rotational axis of the feed wheel. The sealing element can in particular be an inserted sliding piece and be advantageously enclosed between lateral walls of the receptacle, transverse to the rotational axis of the feed wheel, and guided by the lateral walls as it slides.

The feature of generating a pressing force, in particular by means of a hydraulic pressing device, is also advantageous in its own right and not only in connection with the base leakage cross-section. Such a rotary pump, in particular a displacement pump, can be configured in accordance with a housing comprising an inlet and an outlet for a fluid, and a delivery chamber which connects the inlet and the outlet; a feed wheel which can be rotated about a rotational axis in the delivery chamber; an actuating member which surrounds the feed wheel at the circumference and forms delivery cells with the feed wheel and can be moved back and forth in the housing relative to the feed wheel, in an actuating direction and an actuating counter direction, in order to adjust the specific delivery volume of the rotary pump, wherein the control pressure chamber is delineated by the actuating member and axially facing axial co-operating surfaces together, respectively forming an axial sealing gap, and by the actuating member in sliding contact with a circumferential co-operating surface which faces the outer circumference of the actuating member, forming a radial sealing gap, and wherein a control fluid can be introduced into the control pressure chamber for applying pressure to the actuating member, in order to exert an actuating force on the actuating member in the actuating direction; a restoring device for generating a restoring force which acts on the actuating member in the actuating counter direction; and a sealing element which is arranged on the actuating member or the circumferential co-operating surface and situated in the sliding contact, and can also comprise a pressing device for generating the pressing force, in particular the hydraulic pressing device. The feature to compensate for a change in the gap width of one of the axial sealing gaps, by providing a base leakage cross-section on the sealing element, through which control fluid can flow off from the control pressure chamber to a low-pressure side of the pump, need not be realized, but can advantageously be additionally realized, in such a pump. This also applies more broadly to the preferred embodiments which are disclosed in connection with the base leakage cross-section or preferably the plurality of base leakage cross-sections.

The actuating member can be mounted in the pump housing such that it can be linearly moved transverse to the rotational axis of the feed wheel or in particular such that it can be pivoted in a rotary joint. The adjusting movements of the actuating member in and counter to the actuating direction are correspondingly linear movements or pivoting movements in such embodiments. In the pivoting embodiments, the rotational axis in the rotary joint of the actuating member extends parallel to the rotational axis of the feed wheel. The adjusting arrangements cited by way of example are known in principle. If the actuating member can be pivoted, then it is in accordance with preferred embodiments if the actuating member forms an inner joint element of the rotary joint on a side of its outer circumference which faces away from the sealing element, and the housing forms an outer joint element of the rotary joint, i.e. the actuating member forms the shaft of the joint and the housing forms the socket of the joint. A simple and therefore particularly preferred embodiment of the rotary joint is obtained when the outer joint element surrounds the inner joint element over an angle of at most only 180°, preferably less than 180°. The outer joint element is formed as a hollow or a bearing lug which opens over an angle of at least 180° towards the circumferential co-operating surface which forms the radial sealing gap with the actuating member. The actuating member is supported towards one side in the rotary joint and is supported oppositely on the circumferential co-operating surface of the housing. The design is simplified, but the actuating member is still accurately guided within the context of its pivotability. The outer joint element which is open facing the circumferential co-operating surface—open, since it extends over at most 180°—is so to speak closed by means of the circumferential co-operating surface. A stable and robust pivot bearing is also obtained.

In developments, the delivery chamber is connected to either the inlet or preferably the outlet of the pump through the rotary joint of the actuating member. In such embodiments, the inner joint element and outer joint element form a hollow joint. While the connecting channel which extends through the rotary joint can be formed solely by the housing, i.e. in the region of the outer joint element, the inner joint element can however also advantageously form a portion of the cross-section of the connecting channel, if the outer circumference of the inner joint element comprises a recess and/or hollow which forms the partial cross-section of the connecting channel. This helps towards a compact and simple design of the pump.

The pivot bearing of the actuating member as disclosed above is likewise a feature which is advantageous in its own right. While this feature can advantageously be realized in connection with the sealing element and in particular the base leakage cross-section or the pressing device, a displacement pump comprising a housing comprising an inlet and an outlet for a fluid, and a delivery chamber which connects the inlet and the outlet; a feed wheel which can be rotated about a rotational axis in the delivery chamber; an actuating member which surrounds the feed wheel at the circumference and forms delivery cells with the feed wheel and can be moved back and forth in the housing relative to the feed wheel, in an actuating direction and an actuating counter direction, in order to adjust the specific delivery volume of the rotary pump, wherein the control pressure chamber is delineated by the actuating member and axially facing axial co-operating surfaces together, respectively forming an axial sealing gap, and by the actuating member in sliding contact with a circumferential co-operating surface which faces the outer circumference of the actuating member, forming a radial sealing gap, and wherein a control fluid can be introduced into the control pressure chamber for applying pressure to the actuating member, in order to exert an actuating force on the actuating member in the actuating direction; a restoring device for generating a restoring force which acts on the actuating member in the actuating counter direction, and correspondingly the rotary pump is a lubricating oil pump for supplying a combustion engine, which serves as the drive motor of a vehicle, with lubricating oil or is provided for such a use; and the rotary pump is driven by a motor, preferably an internal combustion engine, in a fixed rotational speed relationship and serves to supply the motor, or another unit driven by the motor, with the pressure fluid, however, is also advantageous in its own right alone.

The pump in accordance with the invention can for example be a lubricating oil pump for supplying a combustion engine with lubricating oil or can be provided for such a use. The combustion engine can in particular be the drive motor of a vehicle. If, as is preferred, the displacement pump is driven by the combustion engine in a fixed rotational speed relationship, the absolute delivery volume of the pump is increased at least substantially in proportion to the rotational speed of the pump and therefore the rotational speed of the combustion engine. The absolute delivery volume of the pump can be adapted to the actual requirement of the combustion engine, or another unit to be supplied with the fluid such as for example an automatic transmission, using the adjustability of the specific delivery volume, i.e. the delivery volume per revolution of the feed wheel.

BRIEF DESCRIPTION OF THE DRAWINGS

Example embodiments of the invention are explained below on the basis of figures. Features disclosed by the example embodiments, each individually and in any combination of features, advantageously develop the subjects of the claims and the embodiments explained above.

DETAILED DESCRIPTION

Figure 1:
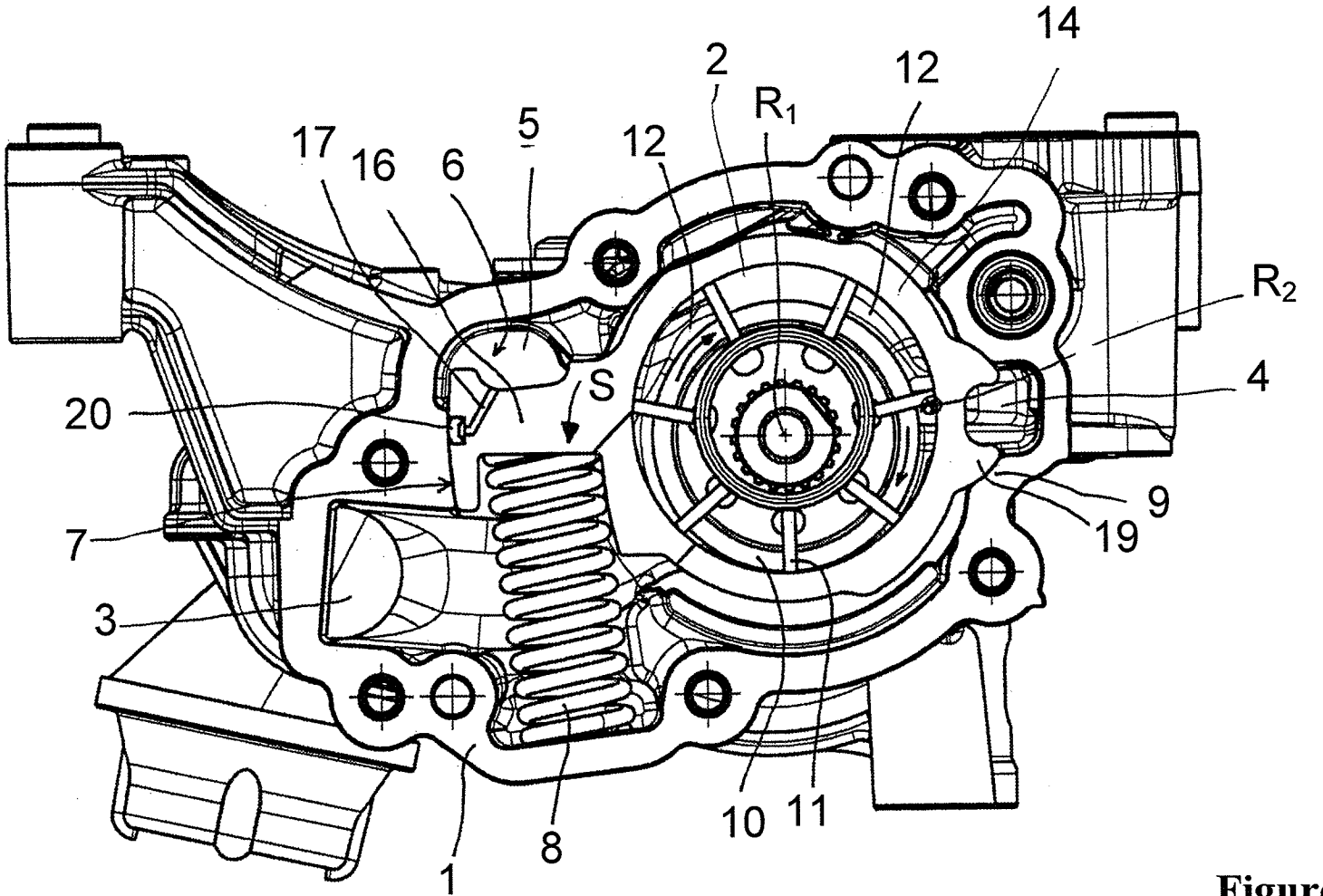
FIG. 1 shows a rotary pump comprising an actuating member and a sealing element of a first example embodiment.

FIG. 1 shows a rotary pump, in a vane cell design by way of example. The pump is shown in a lateral view onto a pump housing 1 of the pump. A cover of the housing 1 has been removed, such that the functional components of the pump can be seen. The housing 1 forms a delivery chamber 2 in which a feed wheel 10 is arranged such that it can be rotated about a rotational axis $R_1$. The housing 1 comprises an inlet featuring an inlet channel 3, and an outlet featuring an outlet channel 4, for the fluid. The delivery chamber 2 comprises a low-pressure side and a high-pressure side. When the feed wheel 10 is rotary-driven in the rotational direction indicated (clockwise), fluid flows via the inlet channel 3 on the low-pressure side into the delivery chamber 2 and is expelled on the high-pressure side at an increased pressure and withdrawn via the outlet channel 4.

The feed wheel 10 is a impeller comprising vanes 11 which are arranged in a distribution about the rotational axis $R_1$. The outer circumference of the feed wheel 10 is surrounded by an actuating member 14 which is for example formed as an actuating ring. When the feed wheel 10 is rotary-driven, its vanes 11 slide over an inner circumferential surface of the actuating member 14. The rotational axis $R_1$ is arranged eccentrically with respect to a parallel central axis of the actuating member 14, such that the delivery member 10 and the actuating ring 14 on the low-pressure side of the delivery chamber 2 together form delivery cells 12 which increase in size in the rotational direction and decrease in size again on the high-pressure side. Due to this periodic increase and decrease in the size of the delivery cells 12 at the rotational speed of the feed wheel 10, the fluid is delivered from the low-pressure side to the high-pressure side, where it is delivered through the outlet channel 4.

The volume of fluid delivered per revolution of the feed wheel 10—the so-called specific delivery volume—can be adjusted. The specific delivery volume is dependent on the eccentricity, i.e. the distance between the central axis of the actuating member 14 and the rotational axis $R_1$. In order to be able to change this axial distance, the actuating member 14 is arranged in the housing 1 such that it can be moved, for example pivoted about a pivoting axis $R_2$. For adjusting in an actuating direction S (in the example embodiment, a pivoting direction S), a control fluid pressure which acts in the actuating direction S is applied to the actuating member 14, and a restoring force is applied, counter to said control pressure in the actuating counter direction, to the actuating member 14. The restoring force is generated by a spring device comprising one or more mechanical spring members—in the example embodiment, one spring member 8. The spring member 8 is embodied and arranged as a helical pressure spring. For applying pressure using the control fluid, the opposite side of the actuating member 14, as viewed from the pivoting axis $R_2$ via the rotational axis $R_1$, comprises an acting region 16 which functionally acts as an actuating piston and is for example formed in one piece with the annular portion of the actuating member 14. On one side of the acting region 16, a control pressure chamber 5 is formed in the housing, into which the control fluid can be introduced in order to exert the actuating force, which acts in the actuating direction S, on the acting region 16 of the actuating member and, via said acting region, on the actuating member 14. The restoring force likewise for example acts directly on the acting region 16 of the actuating member.

The control pressure chamber 5 is delineated by the housing 1 and the actuating member 14, in particular the acting region 16 of the actuating member. The actuating member 14 forms an axial sealing gap with each of the axial co-operating surfaces 6 of the housing 1 which lie axially opposite the two facing sides of the actuating member 14, and forms a radial sealing gap at an outer circumferential region with a radially opposite circumferential co-operating surface 7 of the housing 1 at said outer circumferential region, wherein the terms "axial" and "radial" are merely intended to signify that the gap widths of the axial sealing gaps are measured axially, i.e. parallel to the rotational axis $R_1$, and the gap width of the radial sealing gap is measured in a direction pointing orthogonally with respect to the rotational axis $R_1$. This direction can coincide with a radial onto the rotational axis $R_1$ or can intersect the rotational axis $R_1$ at a distance. The sealing gaps separate the control pressure chamber 5 from the low-pressure side of the pump.

The control pressure chamber 5 is fed with the pressure fluid delivered by the pump. The control fluid is diverted on the high-pressure side of the pump, either while still within the pump housing 1 or at a point between the pump housing 1 and an immediately adjacent downstream consumer, for example between a filter which is arranged downstream of the pump and the next consumer, and is guided from the point of diversion back into the control pressure chamber 5 in order to apply the control fluid pressure to the actuating member 14 in the actuating direction S. The actuating direction S is selected such that the eccentricity between the feed wheel 10 and the actuating member 14 and thus the specific delivery volume decreases in size when the actuating member 14 is moved in the actuating direction S. The application of the control fluid pressure can be embodied such that the control fluid is constantly applied to the control pressure chamber 5 or can be applied in a way controlled by an optional control member. In the example embodiment, only one control pressure chamber 5 is formed on the outer circumference of the actuating member 14 and extends from the acting region 16 of the actuating member towards a pivot bearing of the actuating member 14. In developments, the control pressure chamber 5 can exhibit a smaller extension in the circumferential direction and for example extend substantially over the acting region 16 of the actuating member only, and one or two other control pressure chamber(s) can for example be formed in the circumferential direction towards the pivot bearing of the actuating member 14. If a plurality of control pressure chambers are formed, the application of pressure can for example be configured such that control fluid is constantly applied to one of these control pressure chambers and optionally applied to another in a way which can be controlled by a control member.

A sealing element 20 is arranged in the radial sealing gap at 7, in order to improve the fluidic separation and/or seal between the control pressure chamber 5 and the low-pressure side situated on the other side of the radial sealing gap, as viewed across the radial sealing gap. Due to production tolerances, wear and changes in temperature, the gap width of the radial sealing gap changes on the one hand from pump to pump and on the other over the course of time and lastly also as a function of the operational state of the respective pump. These changes in the gap width of the radial sealing gap are compensated for by means of the sealing element 20. The sealing element 20 is in sliding contact with the circumferential co-operating surface 7 in the radial sealing gap and, for the purpose of compensating, a pressing force which presses the sealing element 20 in the sliding contact is applied to the rear side of the sealing element 20 which faces away from the circumferential co-operating surface 7. Although it would in principle be conceivable to form the sealing element 20 to be inherently elastic in order to generate the pressing force, the pressing force is generated externally in the example embodiment and acts on the sealing element 20. While this could be realized by means of additional spring members or as applicable even one spring member only, the pressing force is however generated hydraulically in the example embodiment, as is preferred. In order to generate the pressing force, control fluid is guided out of the control pressure chamber 5 onto the rear side of the sealing element 20. For this purpose, the actuating member 14 is provided with a connecting channel 17 which leads from the rear side of the sealing element 20 into the control pressure chamber 5 over a short distance.

Figure 2:
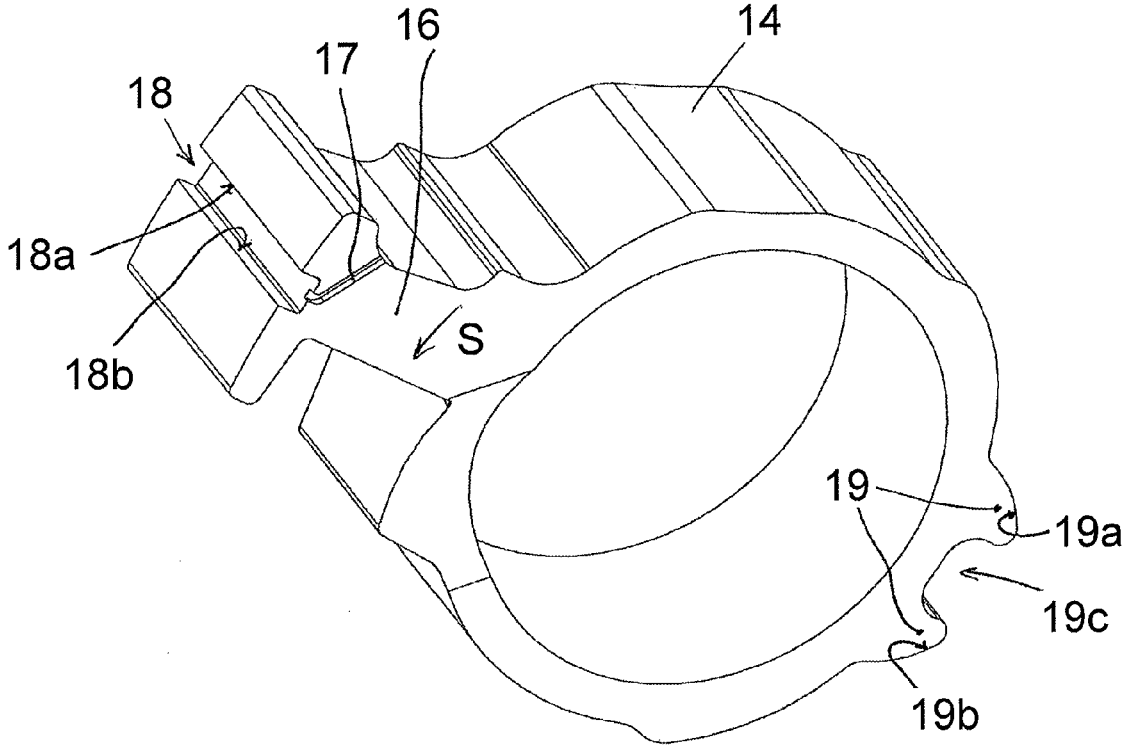
FIG. 2 shows the actuating member comprising a receptacle for the sealing element.
Figure 3:
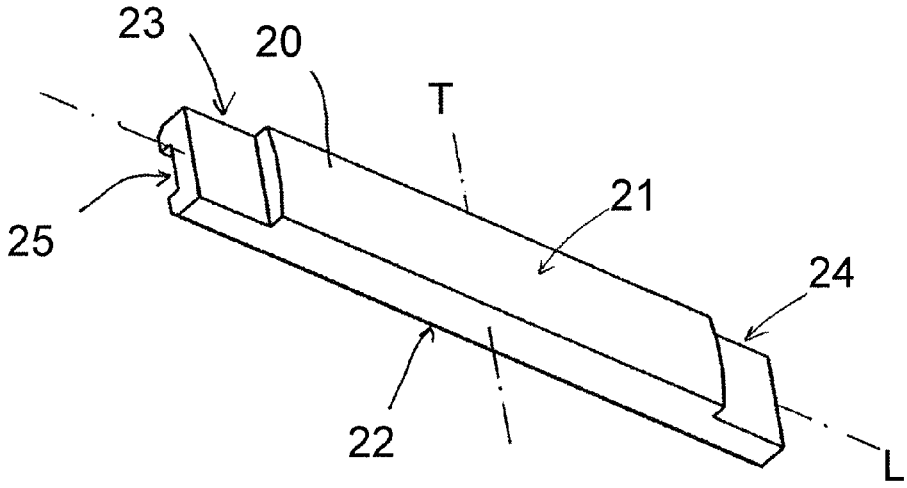
FIG. 3 shows the sealing element of the first example embodiment.

FIGS. 2 and 3 show the actuating member 14 and the sealing element 20 individually, each in a perspective view. The outer circumference of the acting region 16 of the actuating member 14 comprises a receptacle 18 for the sealing element 20 which lies opposite the circumferential co-operating surface 7 (FIG. 1), and a facing side of the actuating member 14 comprises the connecting channel 17. The connecting channel 17 is formed as a recess on one of the two facing sides of the actuating member 14. A connecting channel can likewise be formed on the other facing side, advantageously in the same way as the connecting channel 17; in the example embodiment, however, only one connecting channel 17 is provided. When assembled, the sealing element 20 is arranged in the receptacle 18 such that its front side which faces away from the actuating member 14—the sealing side—lies opposite the circumferential co-operating surface 7 and is in sliding contact with the circumferential co-operating surface 7 when pressure is applied to its rear side 22 situated in the receptacle 18.

The sealing element 20 is produced separately and inserted into the receptacle 18 when the pump is assembled, i.e. it is an insertion piece. When inserted, it can be moved relative to the actuating member 14, at least substantially orthogonally with respect to the circumferential co-operating surface 7. Within the context of this radial mobility, the mutually opposite lateral surfaces 18*a* and 18*b* of the receptacle 18 form guiding surfaces for the sealing element 20. The sealing element 20 can also be axially moved in the receptacle 18. The lateral surfaces 18*a* and 18*b* also guide the sealing element 20 within the context of this mobility. The axial mobility is limited by the axial co-operating surfaces 6 of the housing 1.

The rear side 22 of the sealing element 20, which lies in the receptacle 18 when inserted, comprises a recess 25 which serves to evenly distribute the control fluid, which is guided to the rear side 22 via the connecting channel 17, over the length of the sealing element 20. The recess 25 extends over the entire length of the sealing element 20. It is for example formed as a linear, flat groove. Alternatively, it would also be conceivable to form the recess 25 as a pocket which only extends over a portion of the length of the sealing element 20 on its rear side 22. Forming it as a continuous recess, for example as a linear groove, is however simple to produce and ensures an axially even application of pressure. In order to improve the seal in the radial sealing gap, the front side 21 bulges towards the circumferential co-operating surface 7. The bulge can be adapted to and in particular congruent with a bulge of the circumferential co-operating surface 7. The bulge can also be formed to be more pronounced, in order to obtain a linear contact or at least a contact which approximates a linear contact, in sliding contact with the circumferential co-operating surface 7. Where a sliding contact is mentioned in connection with the sealing element 20, the term "sliding contact" is in particular intended to also include scenarios in which the two surfaces which are situated in sliding contact, namely the front side 21 of the sealing element 20 on the one hand and the circumferential co-operating surface 7 on the other, are wetted with the control fluid, i.e. in which the control fluid serves as a lubricant in the sliding contact.

A base leakage cross-section is formed on the front side 21 in each of the axial end regions of the sealing element 20, namely a left-hand base leakage cross-section 23 and a right-hand base leakage cross-section 24. The base leakage cross-sections 23 and 24 are formed as cavities. They extend from the respective axial end, slightly towards an axial middle of the sealing element 20, and respectively end at a step-shaped shoulder. The front side 21 of the sealing element 20 comprises the bulged sealing surface over the majority of its axial length, wherein the sealing surface drops via a step at the respective axial end, forming the base leakage cross-sections 23 and 24. The cavities 23 and 24 serve to drain control fluid from the control pressure space 5 to the low-pressure side of the pump. In this sense, they form draining or relieving cross-sections—base leakage cross-sections, as mentioned—for the control fluid.

A longitudinal axis which extends parallel to the rotational axis $R_1$ is denoted by L, and a transverse axis of the sealing element 20 which points parallel to the actuating direction S is denoted by T. The base leakage cross-sections 23 and 24 are cross-sectionally dimensioned such that in total, a base leakage flows off through them to the low-pressure side. Because a base leakage is predetermined by means of the base leakage cross-sections 23 and 24 formed on the sealing element 20, a particular pressure level in the control pressure chamber 5, at which an actuating movement in the actuating direction S from the end position assumed by the actuating member 14 in FIG. 1 is initiated, can be more accurately predetermined than in the case of leakage via the sealing gaps delineated by the actuating member 14 and the co-operating surfaces 6 and 7 only.

A plane which is orthogonal to the transverse axis T and contains the longitudinal axis L sub-divides the sealing element 20 into two at least substantially identical longitudinal halves. The transverse axis T extends at the level of the axial middle of the sealing element 20 in FIG. 3. The sealing element 20 is mirror-symmetrical with respect to a plane which points orthogonally with respect to the longitudinal axis L and contains the transverse axis T. When the sealing element 20 is inserted into the receptacle 18, the orientation of the sealing element 20 is therefore free in terms of "left" and "right".

Figure 4:
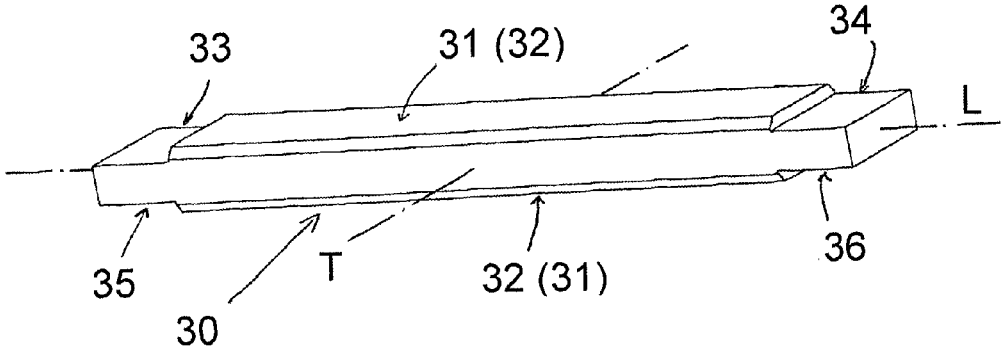
FIG. 4 shows a sealing element of a second example embodiment.

FIG. 4 shows a sealing element 30 in a second example embodiment. The sealing element 30 is not only at least substantially mirror-symmetrical with respect to a middle transverse axis T which extends parallel to the actuating direction S, like the sealing element 20 before it, but is also at least substantially mirror-symmetrical with respect to a middle plane which contains both the longitudinal axis L and the transverse axis T. In other words, the sealing element 30 comprises a front side 31 and a rear side 32 which are at least substantially identical. It is therefore not necessary to differentiate between the front side 31 and rear side 32 when inserting the sealing element 30; the sealing element 30 can instead be inserted into the receptacle 18 unspecifically in this respect. This facilitates installing it, in particular also in mass-production by means of assembling machines. In order to achieve said symmetry with respect to the L-T middle plane, the sealing element 30 also comprises other base leakage cross-sections 35 and 36 on the opposite side—the rear side 32 in FIG. 4—in addition to the two base leakage cross-sections 33 and 34. The base leakage cross-sections 33 to 36 are each formed in the same way as the base leakage cross-sections 23 and 24 of the sealing element 20. The sealing surface formed by the front side 31 corresponds to the sealing surface on the front side 21 of the sealing element 20. The bracketed numbers after the reference signs 31 and 32 in FIG. 4 indicate that the front side and rear side can be interchanged.

Figure 5:
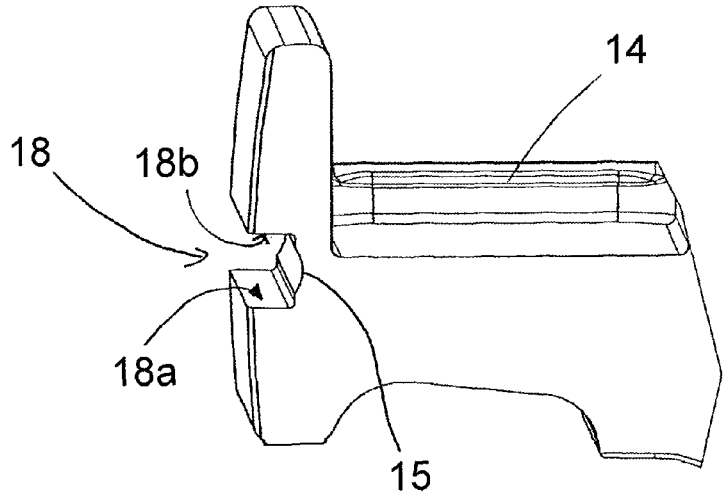
FIG. 5 shows an actuating member comprising a receptacle for the sealing element of the second example embodiment.

FIG. 5 shows an actuating member 14 comprising a receptacle 18, in a second example embodiment. With respect to the receptacle 18 of the first example embodiment (FIGS. 2 and 3), the receptacle 18 is modified for installing the sealing element 30 in a positionally unspecific way, by forming a recess 15 in the receptacle 18 which serves to distribute the control fluid. The recess 15 of the actuating member 14 replaces the recess 25 which is provided on the sealing element 20 in the first example embodiment. The actuating member 14 otherwise corresponds to the actuating member 14 of the first example embodiment.

Figure 6:
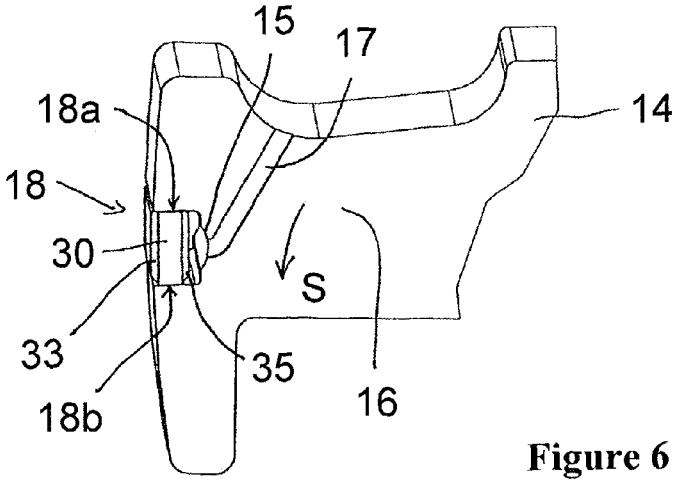
FIG. 6 shows an end region of the actuating member, with the sealing element of the second example embodiment arranged in said end region.

FIG. 6 shows the actuating member 14 in the region of its actuating piston 16, with the sealing element 30 inserted and in a view onto the facing side on which the connecting channel 17 is formed.

Aside from the differences explained with respect to the sealing element 30 and the receptacle 18, a displacement pump comprising the sealing element 30 corresponds to a displacement pump comprising the sealing element 20, such that reference is made to the statements made in connection with the sealing element 20. The actuating member 14 and the sealing element 20 in the displacement pump of FIG. 1 can in particular be exchanged for the actuating member 14 and the sealing element 30 of FIGS. 4 to 6.

The sealing elements 20 and 30, which are arranged in the respectively adapted receptacle 18 of the actuating member 14 and pressed into sliding contact by means of a hydraulically generated pressing force, ensure a seal in the radial sealing gap which remains constant over the entire operational temperature range and over the service life of the displacement pump. A leakage which can be accurately predetermined is set by means of the base leakage cross-sections 23 and 24 and equally the base leakage cross-sections 33 to 36, through which control fluid can flow off from the control pressure space 5 to the low-pressure side of the pump in a correspondingly accurately predeterminable way. This specific leakage serves to compensate for changes in the gap width of the axial sealing gaps formed between the facing sides of the actuating member 14 and the facing axial co-operating surfaces 6, which can occur due to production tolerances and in particular temperature fluctuations while the pump is in operation and also due to a certain degree of wear. Both measures help towards making the pressure level which is predetermined in the design by the control pressure chamber 5 and the actuating piston 16 and also the spring device 8 and at which the actuating member 14 begins to be moved out of the end position shown in FIG. 1 for a maximum specific delivery volume in the actuating direction S and therefore in the direction of a minimum specific delivery volume comparatively invariant. It is possible to ensure, more accurately than in the prior art and even in the event of temperature fluctuations, wear and production tolerances, that the down-regulating process is initiated at the pressure level for which the pump is designed.

The pivot bearing of the actuating member 14 also exhibits particular advantages. The housing 1 and the actuating member 14 together form a rotary joint, comprising joint elements 9 and 19, for the pivot bearing. The joint element 9 is formed by the housing 1 and is the outer joint element, i.e. the socket of the rotary joint 9, 19. The joint element 19 is formed by the actuating member 14 and is the inner joint element, i.e. the shaft of the rotary joint 9, 19.

A first particularity is that the outer joint element 9 encompasses the inner joint element 19 at the outer circumference over an angle of at most—and in the example, less than—180°, such that the actuating member 14 is only held in the joint 9, 19 when the joint element 19 is pressed into the cup formed by the joint element 9. Conversely, the pivoting axis $R_2$ is predetermined in the sliding contact between the circumferential inner surface of the joint element 9 and the facing circumferential outer surface 19*a* and 19*b* (FIG. 2) of the joint element 19. Opposite the open side of the bearing lug formed by the joint element 9, a counter bearing is formed over the radial sealing gap between the actuating member 14 and the circumferential co-operating surface 7. One or more other counter bearings can be formed in a distribution over the circumference of the actuating member 14, for example in embodiments in which one or more other control pressure chamber(s), such as for example the optional control pressure chamber 5', are provided. Forming the joint element 9 as a bearing lug which is open towards the rotational axis $R_1$ of the feed wheel 10 is advantageous, on the one hand in order to avoid redundancy in mounting the actuating member 14 and therefore improve the pivot bearing, but also in order to facilitate assembly.

A second particularity is that the rotary joint 9, 19 is formed as a hollow joint, through which the outlet channel 4 extends which connects the high-pressure side of the delivery chamber 2 to the pump outlet. In the hollow joint, the joint element 19 forms a portion of the cross-section of the outlet channel 4. The housing 1 forms the remaining cross-section. For this purpose, the outer circumference of the joint element 19 comprises a recess or hollow 19*c*, i.e. in forming the rotary joint 9, 19, the joint element 19 is not in sliding contact with the joint element 9 over its entire outer circumferential surface, but rather only in a sliding region 19*a* situated to the left of the recess and a sliding region 19*b* situated to the right of the recess. In other words, the actuating member 14 comprises: the left-hand circumferential sliding region 19*a* for its pivot bearing and for forming the rotary joint 9, 19; the right-hand circumferential sliding region 19*b*; and the hollow-shaped recess 19*c* for forming the outlet channel 4 between these two sliding regions 19*a* and 19*b*.

REFERENCE SIGNS

1 pump housing
2 delivery chamber
3 inlet channel
4 outlet channel
5 control pressure chamber
6 axial co-operating surface
7 circumferential co-operating surface
8 spring member
9 outer joint element
10 feed wheel
11 vane
12 delivery cell
13 -
14 actuating member
15 recess
16 acting region of the actuating member
17 connecting channel
18 receptacle
18*a* guide, lateral surface

18*b* guide, lateral surface
19 inner joint element
19*a* circumferential sliding surface
19*b* circumferential sliding surface
19*c* recess
20 sealing element
21 front side
22 rear side
23 base leakage cross-section
24 base leakage cross-section
25 recess
26 -
27 -
28 -
29 -
30 sealing element
31 front side
32 rear side
33 base leakage cross-section
34 base leakage cross-section
35 base leakage cross-section
36 base leakage cross-section
$R_1$ rotational axis of the feed wheel
$R_2$ pivoting axis of the actuating member
L longitudinal axis of the sealing element
T transverse axis of the sealing element
S actuating direction of the actuating member

The invention claimed is:

1. A rotary pump with an improved seal on a control pressure chamber, comprising:

a housing comprising an inlet and an outlet for a fluid, and a delivery chamber which connects the inlet and the outlet;

a feed wheel which can be rotated about a rotational axis in the delivery chamber;

an actuating member which surrounds the feed wheel at the circumference and forms delivery cells with the feed wheel and can be moved back and forth in the housing relative to the feed wheel, in an actuating direction and an actuating counter direction, in order to adjust the specific delivery volume of the rotary pump, wherein the control pressure chamber is delineated by the actuating member and axially facing axial co-operating surfaces together, respectively forming an axial sealing gap, and by the actuating member in sliding contact with a circumferential co-operating surface which faces the outer circumference of the actuating member, forming a radial sealing gap, and wherein a control fluid can be introduced into the control pressure chamber for applying pressure to the actuating member, in order to exert an actuating force on the actuating member in the actuating direction;

a restoring device for generating a restoring force which acts on the actuating member in the actuating counter direction; and a sealing element which is arranged on the actuating member or the circumferential co-operating surface and situated in the sliding contact, wherein in order to compensate for a change in the gap width of one of the axial sealing gaps, a base leakage cross-section is provided on the sealing element, through which control fluid can flow off from the control pressure chamber to a low-pressure side of the pump.

2. The rotary pump according to claim 1, wherein the base leakage cross-section is formed or provided on the sealing element such that the sealing element as a whole is axially short of the actuating member, at least at one axial end.

3. The rotary pump according to claim 1, wherein the sealing element extends in the region of the radial sealing gap over the entire axial length of the actuating member and forms a sealing gap with one of the axial co-operating surfaces at each of the two axial ends.

4. The rotary pump according to claim 1, wherein a cavity which forms the base leakage cross-section is provided, at an axial end of the sealing element.

5. The rotary pump according to claim 1, wherein a cavity which forms the base leakage cross-section is formed on a front side of the sealing element which faces the circumferential co-operating surface or on a rear side of the sealing element which faces the actuating member, wherein the cavity extends as far as an axial end of the sealing element.

6. The rotary pump according to claim 1, wherein a base leakage cross-section is provided at each of the two axial ends of the sealing element.

7. The rotary pump according to claim 1, wherein the sealing element comprises two or more of the base leakage cross-sections, and the base leakage cross-sections are provided mirror-symmetrically with respect to a transverse axis of the sealing element which extends in an actuating direction, or the front side and rear side of the sealing element are identical at least to the extent that the front side or rear side of the sealing element can optionally be inserted into a receptacle of the actuating member, pointing towards the circumferential co-operating surface, or into a receptacle of the circumferential co-operating surface, pointing towards the outer circumference of the actuating member.

8. The rotary pump according to claim 1, further comprising a pressing device for generating a pressing force which presses the sealing element into sliding contact, wherein the pressing device for generating the pressing force comprises a spring member or a connecting channel through which a fluid, which can be the control fluid, can be applied to the rear side of the sealing element which faces away from the sliding contact.

9. The rotary pump according to claim 8, wherein the connecting channel is formed on the actuating member as a passage channel or as a recess on a surface, which can be an axial end surface of the actuating member.

10. The rotary pump according to claim 1, wherein a recess is formed between the actuating member and the sealing element on a rear side of the sealing element which faces away from the sliding contact or on the actuating member, facing said rear side, and the fluid can be applied to the recess via the connecting channel, and the recess is connected to the control pressure chamber.

11. The rotary pump according to claim 10, wherein the connecting channel is formed on the actuating member as a passage channel or as a recess on a surface, which can be an axial end surface of the actuating member.

12. The rotary pump according to claim 1, wherein the recess extends axially up to and into at least one of the sealing gaps formed with the axial co-operating surfaces and over the entire length of the sealing element or actuating member up to and into the sealing gaps formed with the axial co-operating surfaces.

13. The rotary pump according to claim 12, wherein the connecting channel is formed on the actuating member as a passage channel or as a recess on a surface, which can be an axial end surface of the actuating member.

14. The rotary pump according to claim 1, wherein the sealing element is arranged in a receptacle of the actuating member or a wall which forms the circumferential co-operating surface, such that it can be moved transverse to the rotational axis of the feed wheel, which can be as an inserted sliding piece.

15. The rotary pump according to claim 1, wherein: the actuating member is mounted in a rotary joint such that it can be pivoted about a pivoting axis, for adjusting the specific delivery volume; on a side which faces away from the sealing element, the actuating member forms an inner joint element of the rotary joint and the housing forms an outer joint element of the rotary joint; and the outer joint element surrounds the inner joint element over an angle of at most 180°.

16. The rotary pump according to claim 1, further comprising at least one of the following features:

(i) the rotary pump is a lubricating oil pump for supplying a combustion engine, which serves as the drive motor of a vehicle, with lubricating oil or is provided for such a use;

(ii) the rotary pump is driven by a motor in a fixed rotational speed relationship and serves to supply the motor, or another unit driven by the motor, with the pressure fluid.

17. The rotary pump according to claim 16, wherein the motor is an internal combustion engine.

18. The rotary pump according to claim 1, wherein the actuating member delineates another control pressure chamber in another sliding contact with another circumferential co-operating surface which faces the outer circumference of the actuating member and with the axially facing axial co-operating surfaces, wherein the control fluid or another control fluid can be introduced into the other control pressure chamber for applying pressure to the actuating member, in order to exert another actuating force on the actuating member in or counter to the actuating direction; another sealing element which is situated in the other sliding contact is arranged on the actuating member or on the other circumferential co-operating surface; and in order to compensate for a change in the gap width of one of the axial sealing gaps, a base leakage cross-section is likewise provided on the other sealing element or on one of the co-operating surfaces which face the other sealing element, wherein control fluid can flow off from the other control pressure chamber through said base leakage cross-section.

* * * * *